US005186607A

United States Patent [19]

Yang et al.

[11] Patent Number: 5,186,607

[45] Date of Patent: Feb. 16, 1993

[54] SWIRL GENERATOR WITH AXIAL VANES

[75] Inventors: Shyh-Ching Yang; Li-Chiang Chen, both of Hsinchu, Taiwan

[73] Assignee: Industrial Technology Research Institute, Hsinchu, Taiwan

[21] Appl. No.: 831,447

[22] Filed: Feb. 5, 1992

[51] Int. Cl.[5] ..... F01D 1/02

[52] U.S. Cl. ..... 415/183; 415/191; 415/208.1

[58] Field of Search ..... 415/182.1, 183, 191, 415/208.1, 189; 431/9, 181, 182, 183, 185; 239/487, 488, 489

[56] References Cited

U.S. PATENT DOCUMENTS 4,695,225 9/1987 Hellat et al. ..... 415/189

FOREIGN PATENT DOCUMENTS 49609 4/1980 Japan ..... 431/183

*Primary Examiner*—Thomas E. Denion

*Attorney, Agent, or Firm*—Cushman, Darby & Cushman

[57] ABSTRACT

Disclosed is an axial vane for a swirl generator according to mathematical equation so that the air flow is gradually deviated with minimized pressure drop and turbulence intensity.

5 Claims, 8 Drawing Sheets

SWIRL GENERATOR WITH AXIAL VANES

This is a Continuation-in-part application of a prior application No. 07-620,765, dated Dec. 3, 1990.

FIELD OF THE INVENTION

The present invention relates generally to a swirl generator, and particularly to a swirl generator with specially designed axial vanes.

BACKGROUND OF THE INVENTION

A burner is one of the most important parts of a combustion system. The performance of the burner not only greatly influences the combustion efficiency, but also closely relates to the stability of combustion flame, the effective utilization of the fuel, and the discharge of pollutants. Improper combustion methods and improper selection of burners not only influences the effective use of energy, but also results in air pollution due to emission of large amount of hazardous matters such as $NO_x$ because of undue combustion.

In order to improve the performance of the burner while decreasing the amount of $NO_x$ formed in the combustion process and increasing the stability of the combustion flame, it is necessary to reduce the peak temperature of the flame, to control the residence time of combustion gas, and to form local fuel-rich combustion.

The dramatic effects of swirl in reacting flow systems have been known and appreciated for many years. Some effects are favorable, and the designer strives to generate the required amount of swirl for his particular purpose; other effects are undesirable, and the designer is then at pains to control and curtail its occurrence. In combustion systems, the strong favorable effects of applying swirl to injected air and fuel are extensively used as an aid to stabilization of the high intensity combustion process and efficient clean combustion in a variety of practical situations: gasoline engines, diesel engines, gas turbines, industrial furnaces, utility boilers, and many other practical heating devices.

Swirling flows result from the application of a spiraling motion, a swirl velocity component (also known as a tangential or azimuthal velocity component) being imparted to the flow by the use of swirl vanes, by the use of axial-plus-tangential entry swirl generators, or by direct tangential entry into the chamber. Experimental studies show that swirl has large-scale effects on flow fields: jet growth, entrainment and decay (for inert jets) and flame size, shape stability and combustion intensity (for reacting flows) are affected by the degree of swirl imparted to the flow. This degree of swirl is usually characterized by the swirl number S, which is a nondimensional number representing axial flux of swirl momentum divided by axial flux of axial momentum times the equivalent nozzle radius. That is $$S = \frac{G_\Theta}{G_x d/2}$$

where $G_\Theta$ = is the axial flux of swirl momentum, including the $x - \Theta$ direction turbulent shear stress term, -continued $G_x$ = is the axial flux of axial momentum, including the $x$ direction turbulent normal stress term and a pressure term (axial thrust), and $d/2$ = nozzle radius = velocity components in $(x, r, \Theta)$ cylindrical polar coordinate directions.

Swirl flows are generated by three principal methods—

1. tangential entry (axial-plus-tangential entry swirl generator)
2. guided vanes (swirl vane pack or swirler)
3. direct rotation (rotating pipe).

Among these methods, commercial burners have tended to adopt the guided vane system, where vanes are positioned so that they deflect the flow direction. A conventional burner usually feeds air into the combustion chamber by means of a fan or a compressor and using blades of fixed radial type to mix the air with the fuel for burning. However, it is found that the performance of the burner will become very poor if the pressure drop is too large and the turbulence intensity is too high when the air flows through the fixed radial blades in the conventional burner for forming swirling flow, which is required for combustion.

SUMMARY OF THE INVENTION

It is therefore a primary purpose of this invention to provide a swirl generator, for the burner, adapted to produce a swirling flow having low pressure drop and low turbulence intensity, and being capable of controlling local fuel-rich combustion, controlling the residence time of combustion gas, and finally, improving combustion flame stability.

BRIEF DESCRIPTION OF THE FIGURES

The present invention will become more fully understood from the detailed description given hereinbelow and the accompanying drawings which are given by way of illustration only, and thus are not limitative to the present invention and wherein.

DETAILED DESCRIPTION OF THE PREFERRED EMBODIMENT

Figure 1:
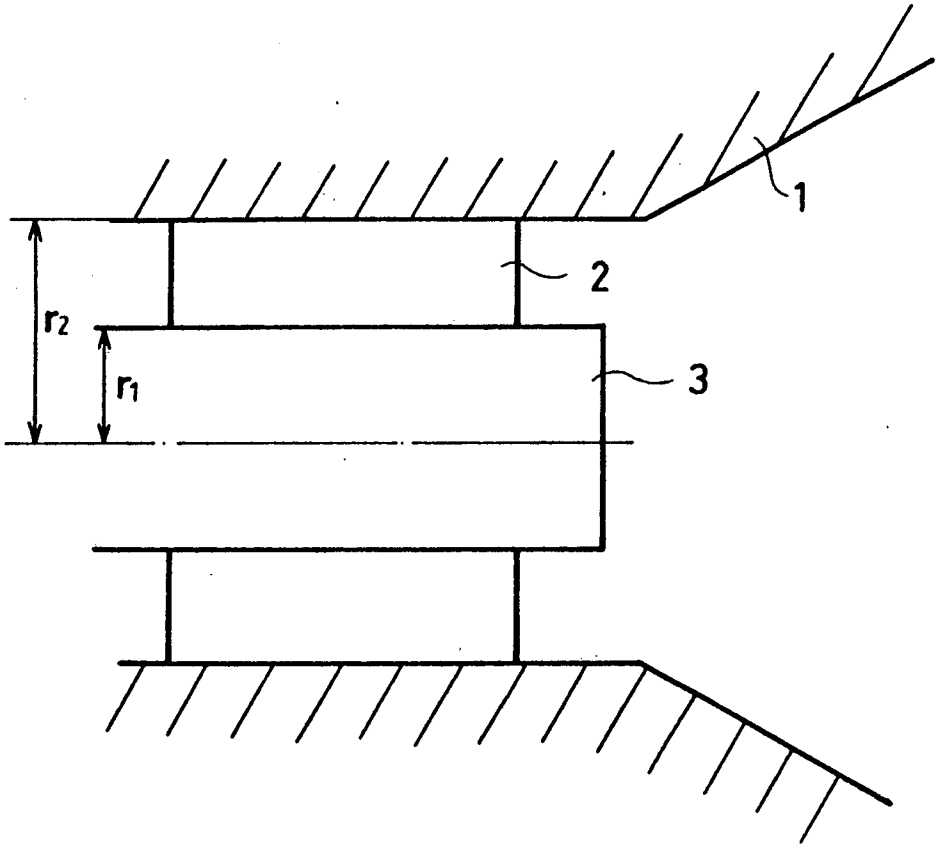
FIG. 1 is a schematic cross-sectional view showing a swirl generator according to the present invention installed in a burner.

FIG. 1 shows a swirl generator accommodated in a burner to produce swirling air flow required for a combustion chamber in accordance with this invention. The burner has a refractory wall 1, a swirl generator 2, and a fuel gun 3. The significants of the symbols used in this specification are described as follows:

$r_1$ : inner radius of the swirl generator;

$r_2$ : outer radius of the swirl generator;

$R_1$ : radius of curvature of the lower boundary of a vane;

$R_2$ : radius of curvature of the upper boundary of a vane;

$\Theta$ : deviation angle (the angle between the tangential direction and the axial direction of a vane);

$\Theta_o$ : deviation angle at the end of a vane;

S : swirl number;

L : length of the projection of the lower boundary of a vane on the axial direction;

l : length of the lower boundary of a vane;

u : distance between a point on a vane and the origin.

The radius of curvature of a point on a vane R is proportional to the diameter r, i.e. $R_1:R_2=r_1:r_2$. The deviation angle $\Theta$ gradually increases from 0 to $\Theta_o$ along the axial direction.

The swirl generator according to the present invention is constructed by affixing n vanes equally spaced on a hollow tube which has a radius of $r_1$ and a length of L. Air is merely disturbed while passing through the swirl generator, so the turbulence and the pressure drop are eliminated.

Making reference to "Combustion Aerodynamics" by J. M. Beer and N. A. Chigier, Robert E. Krieger Publishing Company, Malabar, Flor., 1983 Page 112, Eqn. (5.14b), the swirl number S of the present invention can be approached by $$S = \frac{2}{3}\left[\frac{1-(r_1/r_2)^3}{1-(r_1/r_2)^2}\right]\tan\Theta_o$$

Figure 2:
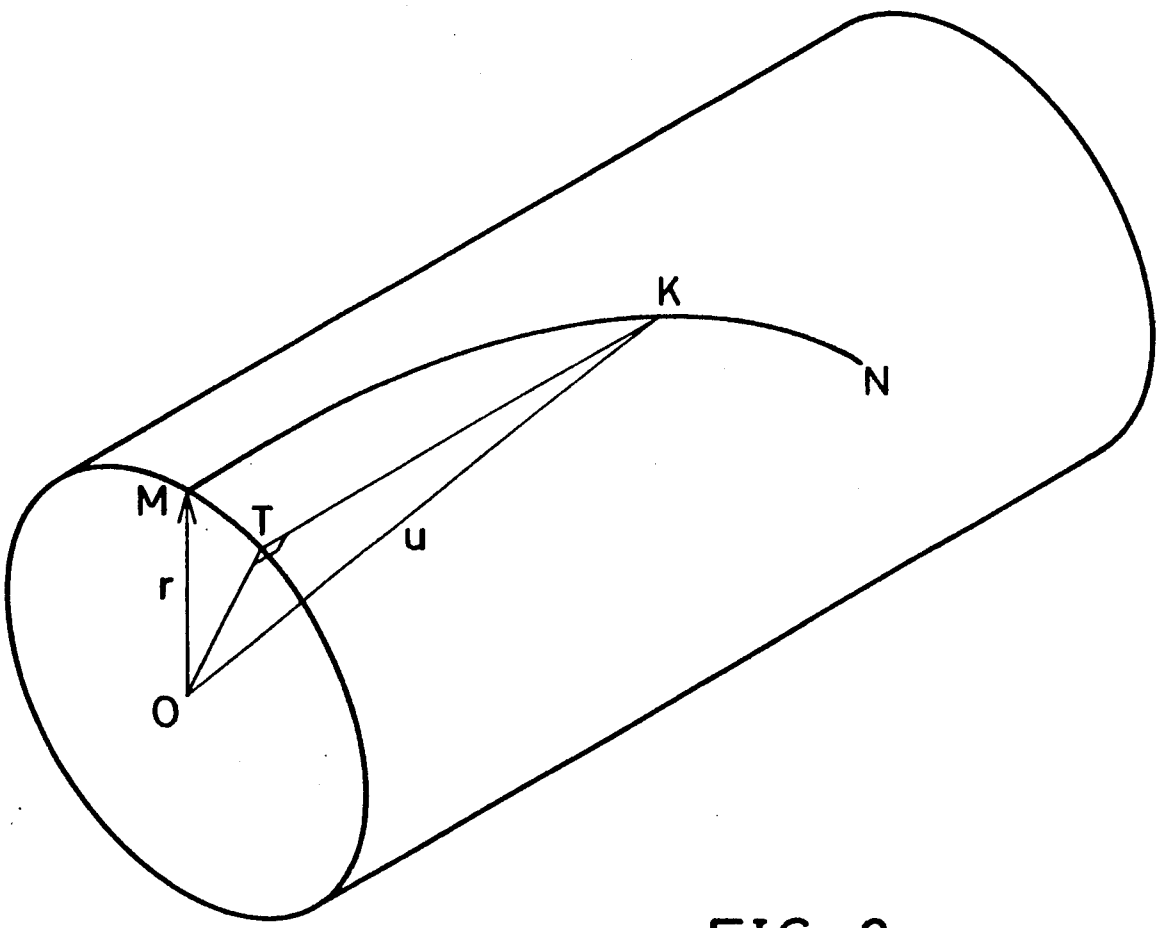
FIG. 2 is a schematic perspective view showing a locus of a vane of the swirl generator according to the present invention on a surface of a cylinder.
Figure 3:
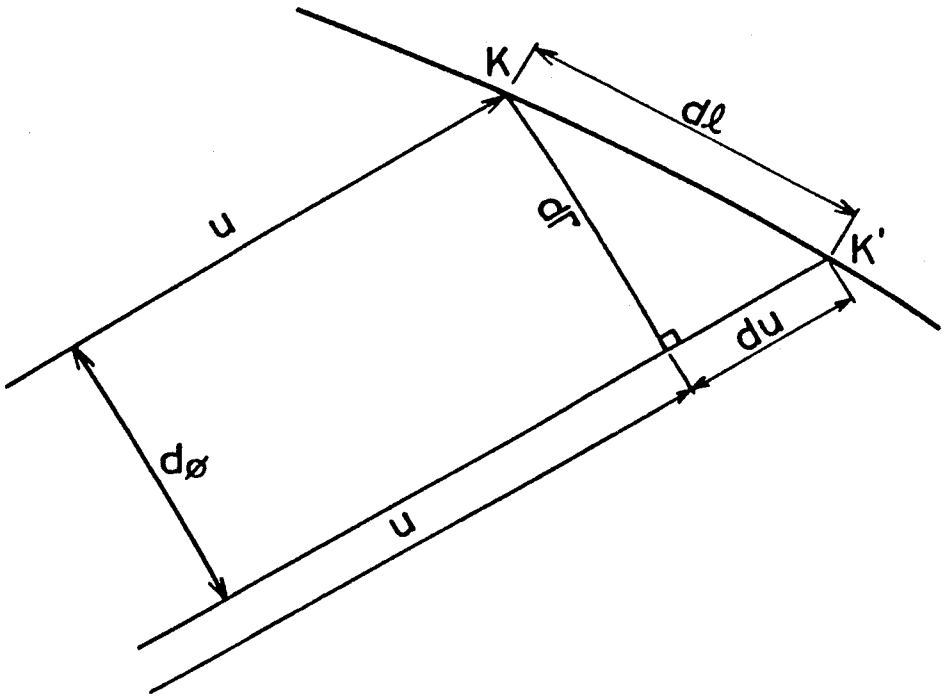
FIG. 3 is a partly exaggerated diagram of the locus shown in FIG. 2.
Figure 4:
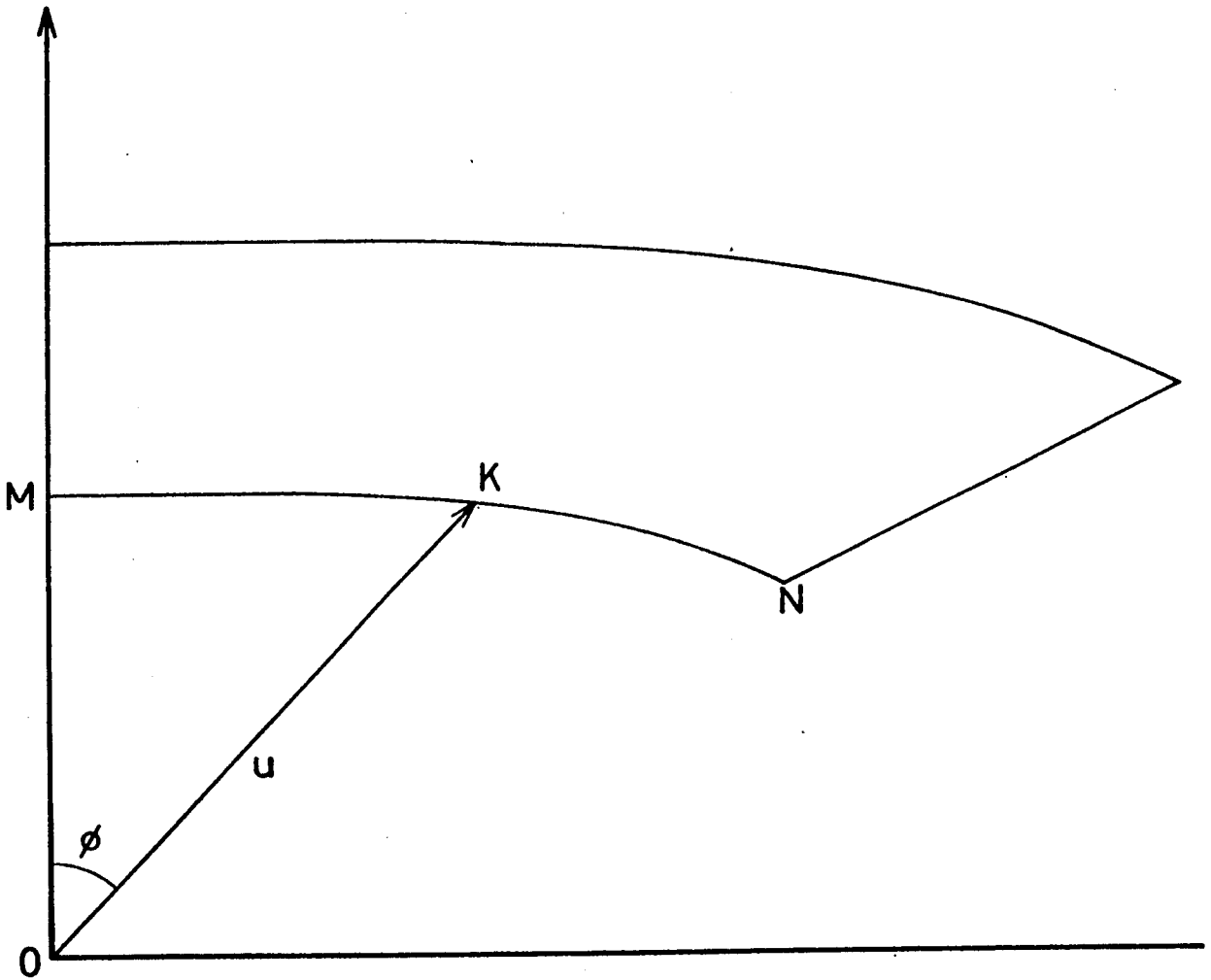
FIG. 4 shows the development of the vane on a plane.

Please refer to FIGS. 2, 3 and 4. The vanes of the present invention is a three dimensional curved surface. The designing principles are discussed below. The development of this curved surface on a plane is shown in FIG. 4. Because the equations of the lower boundary and the upper boundary are alike, we consider only the lower boundary in further discussions.

Figure 5:
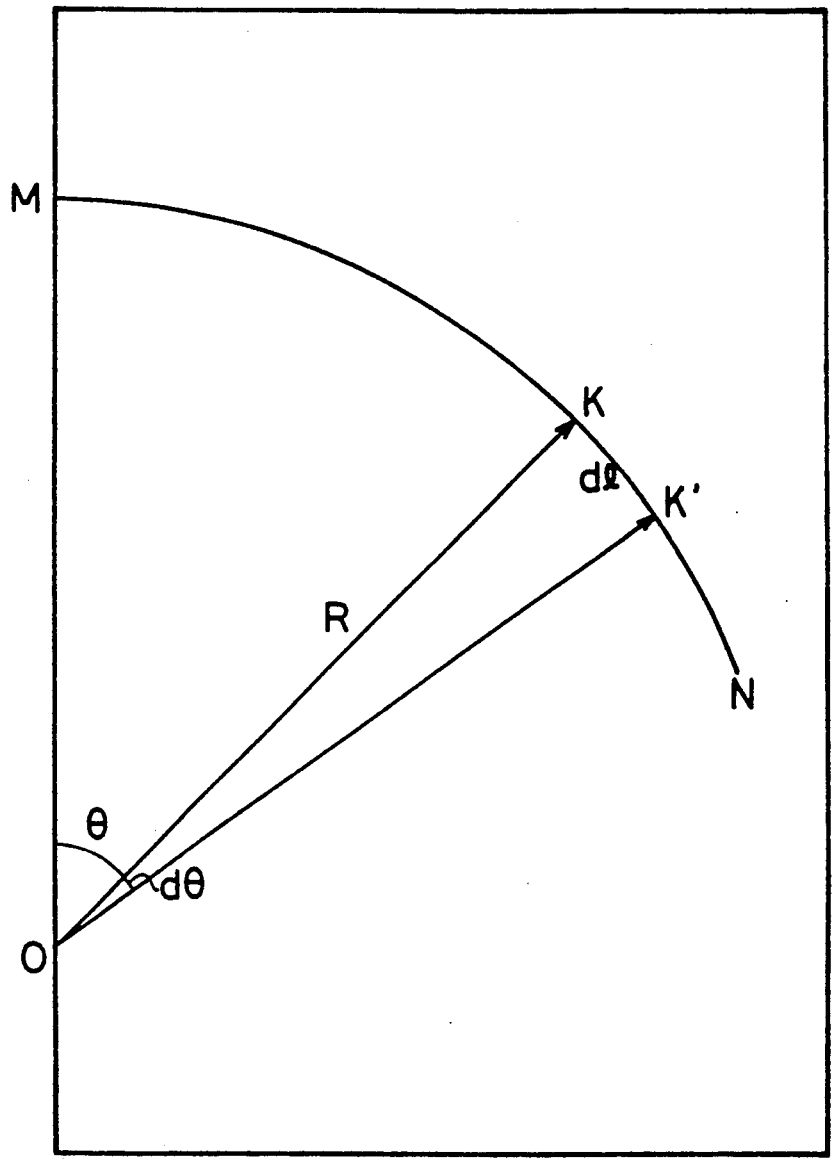
FIG. 5 shows the lower boundary of the vane on the development of the surface of the cylinder, having a radius of curvature of R.

For an arbitrary point K of the lower boundary MN, the locus of point K is denoted as (u, $\phi$) in polar coordinates where u is the distance between point K and the origin, and $\phi$ is the angle of KOM. As shown in FIG. 2, MN is a curve on a cylinder having a radius r, with a radius of curvature of R as shown in FIG. 5.

By Pythagorean theorem,

By Pythagorean theorem, $$OK^2 = OT^2 + TK^2 \quad (1)$$

where $$OK = u,\ OT = r,\ TK = R\sin\Theta,$$

then $$u^2 = r^2 + (R\sin\Theta)^2 \quad (2)$$

thus $$u = (r^2 + R^2\sin^2\Theta)^{\frac{1}{2}}. \quad (3)$$

Please refer to FIG. 3 showing the neighborhood of point K. Point K′ is a point of curve MN with a differential distance dl to point K. The polar coordinates of K′ is (u+du, $\phi$+d$\phi$).

From FIG. 5, $$dl = R\,d\Theta. \quad (4)$$

From FIG. 3 and Pythagorean theorem, $$(dl)^2 = (du)^2 + (d\Gamma)^2 \quad (5)$$

where $d\Gamma = u\,d\phi$. (6)

From eq. (5), $$d\Gamma = [(dl)^2 - (du)^2]^{\frac{1}{2}}. \quad (7)$$

From eq. (6), $$d\phi = \frac{d\Gamma}{u}. \quad (8)$$

By integration, $$\phi = \int (d\Gamma/u). \quad (9)$$

Substitute into eq. (7), $$\phi = \int \{[(dl)^2 - (du)^2]^{\frac{1}{2}}/u\} \quad (10)$$

where $$du = \frac{du}{d\Theta}\,d\Theta = R^2\sin\Theta\cos\Theta\,(r^2 + R^2\sin^2\Theta)^{-\frac{1}{2}}\,d\Theta. \quad (11)$$

Substitute eqs. (3), (4) and (11) into eq. (10), $$\phi = \int \frac{\{(Rd\Theta)^2 - [R^2\sin\Theta\cos\Theta\,(r^2 + R^2\sin^2\Theta)^{-\frac{1}{2}}\,d\Theta]^2\}^{\frac{1}{2}}}{(r^2 + R^2\sin^2\Theta)^{\frac{1}{2}}} = R\int\left[\frac{1 - R^2(r^2 + R^2\sin^2\Theta)^{-1}\sin^2\Theta\cos^2\Theta}{r^2 + R^2\sin^2\Theta}\right]^{\frac{1}{2}} d\Theta. \quad (12)$$

Therefore, if the deviation angle $\Theta$ at point K is $\Theta_k$, then the polar coordinates of point K on the development as shown in FIG. 4 can be represented as (u, $\phi$), where $$\begin{cases} u = (r^2 + R^2\sin^2\Theta_k)^{\frac{1}{2}} \\ \phi = R\int_0^{\Theta_k}\left[\dfrac{1 - R^2(r^2 + R^2\sin^2\Theta)^{-1}\sin^2\Theta\cos^2\Theta}{r^2 + R^2\sin^2\Theta}\right]^{\frac{1}{2}} d\Theta. \end{cases} \quad (13)$$

Substituting the inner and outer diameters of the swirl generator, the radiuses of curvature of the lower and upper boundaries of a vane $r_1$, $r_2$, $R_1$, $R_2$, and the deviation angle $\Theta_k$ from 0 to $\Theta_o$ into eq. (13), we can obtain the development of the vane. After that, flat vanes can be manufactured by manual cutting or by a numerical controlled machine. Bend the vanes to conform the locus shown in FIG. 2, and fix the them on a hollow tube which has a radius of $r_1$, then the swirl generator according to the present invention is finished.

Figure 6:
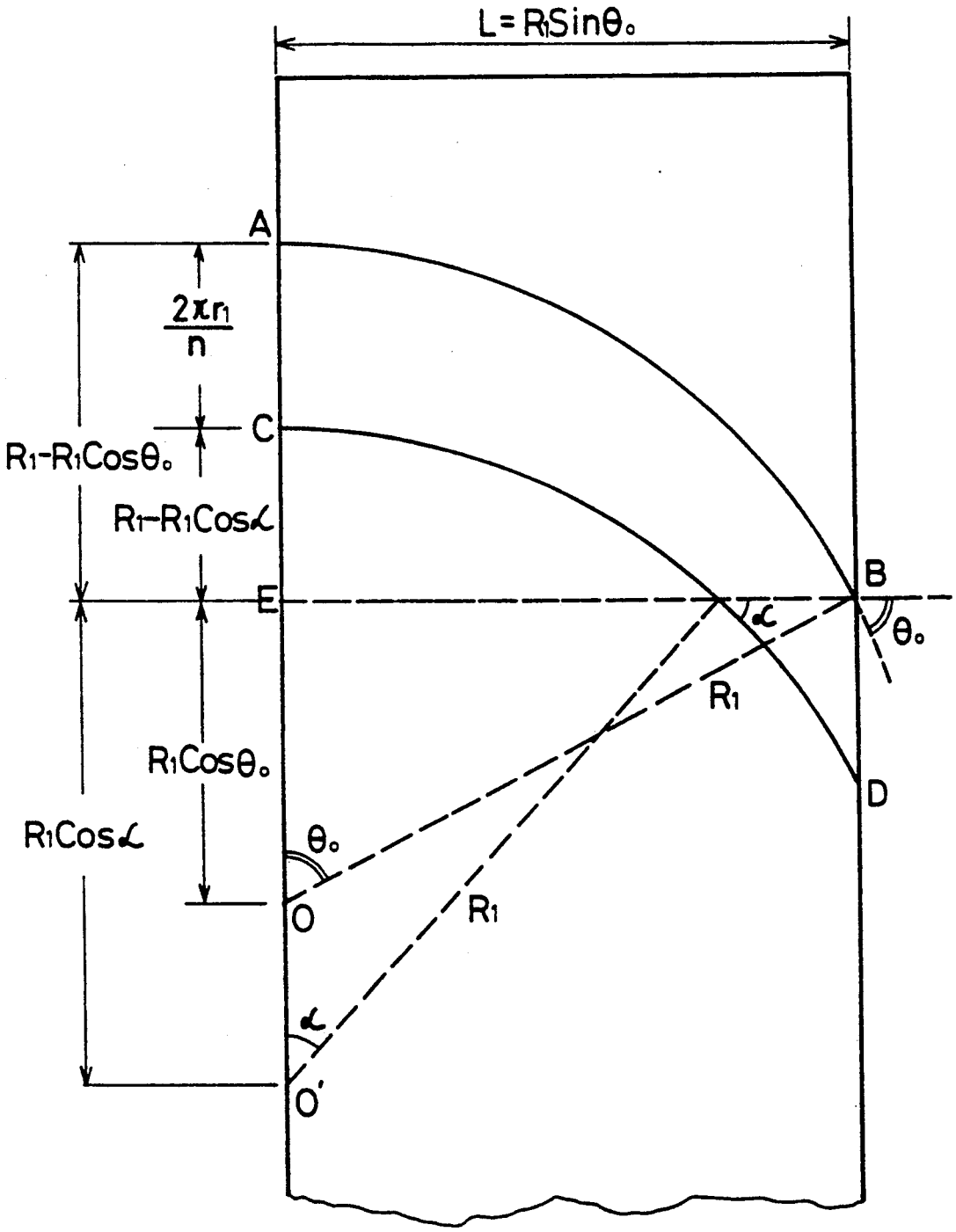
FIG. 6 shows the lower boundaries of two neighboring vanes on the development of the surface of the cylinder, both having a radius of curvature of $R_1$.

The total number of the vanes can be found as shown below:

The total number of the vanes n relates to the radius of the cylinder $r_1$, the radius of curvature of the lower boundary of the vane $R_1$, the deviation angle at the end of the vane $\Theta_o$, and the overlapping angle of vanes $\alpha$. The development of the surface of the cylinder is shown in FIG. 6, where the arc AB and CD are the loci of the lower boundaries of two neighboring vanes. The definition of the overlapping angle $\alpha$ is the angle between the axial line passing through point B and the tangent line of arc CD at point B. The lengths of segments AC, CE, AE, EO, and EO′ are shown in FIG. 6. Since $$AE = AC + CE$$

thus $$R_1 - R_1 \cos\Theta_o = \frac{2\pi r_1}{n} + R_1 - R_1 \cos\alpha. \quad (14)$$

Rearrange eq. (14)

$$n = \frac{2\pi r_1}{R_1(\cos\alpha - \cos\Theta_o)} \quad (15)$$

where n should be taken as the closest natural number.

The deviation angle at the end of the vane $\Theta_o$ can be obtained as shown below:

Rearranging eq. (1), the deviation angle at the end of the vane $\Theta_o$ is $$\Theta_o = \tan^{-1}\left[\frac{3S[1-(r_1/r_2)^2]}{2[1-(r_1/r_2)^3]}\right]. \quad (16)$$

The radius of curvature of the lower boundary of the vane $R_1$ can be obtained as shown below:

$R_1$ can be obtained from the length of the projection of the lower boundary of a vane on the axial direction L and the deviation angle at the end of the vane $\Theta_o$ as shown in FIG. 6

$$R1 = \frac{L}{\sin\Theta_o} \quad (17)$$

The selection of the overlapping angle between two neighboring vanes $\alpha$ is shown below:

The overlapping angle between two neighboring vanes $\alpha$ is shown in FIG. 6. While designing the swirl generator, for achieving the desired swirl number, $\alpha$ is proportional to $\Theta_o$ $$\alpha = k\,\Theta_o \quad (18)$$

where k is a predetermined constant. The greater the k value, the more the overlap between vanes, i.e. the vanes are more intensive. The preferred k value ranges from 0.5 to 0.75, that is $$\alpha = 0.5\,\Theta_o - 0.75\,\Theta_o \quad (19)$$

whereby a satisfactory swirling effect can be produced. In practice, the preferred value of $\alpha$ ranges from 20° to 45°. The most preferred value of $\alpha$ is 30°.

The process of manufacturing a swirling generator according to the present invention is listed as follows:

1. Select the values of $r_1$, $r_2$, S, $\alpha$, and L according to the requirements.
2. Obtain the value of $\Theta_o$ from eq. (16).
3. Obtain the value of $R_1$ from eq. (17), then find the value of $R_2$ from the rational relationship $R_2 = R_1 \times (r_2/r_1)$.
4. Plot the locus of the lower boundary of a vane on a plane according to eq. (13).
5. Plot the locus of the upper boundary of a vane on a plane according to eq. (13).
6. Connect the beginnings and the ends of the lower boundary and the upper boundary obtained in step 4 and step 5, then the lines form the development of a vane.
7. Produce a vane according to the development.
8. Bend the vane to conform the locus shown in FIG. 2 in order to obtain a standard vane.
9. Find the total number of vanes from eq. (15).
10. Repeat step 1 to step 8 to obtain n standard vanes.
11. Fix the n standard vanes equally spaced by $2\pi r_1/n$ on a tube having a radius of $r_1$ and a length of L, thus obtaining a swirl generator according to the present invention.

Figure 7:
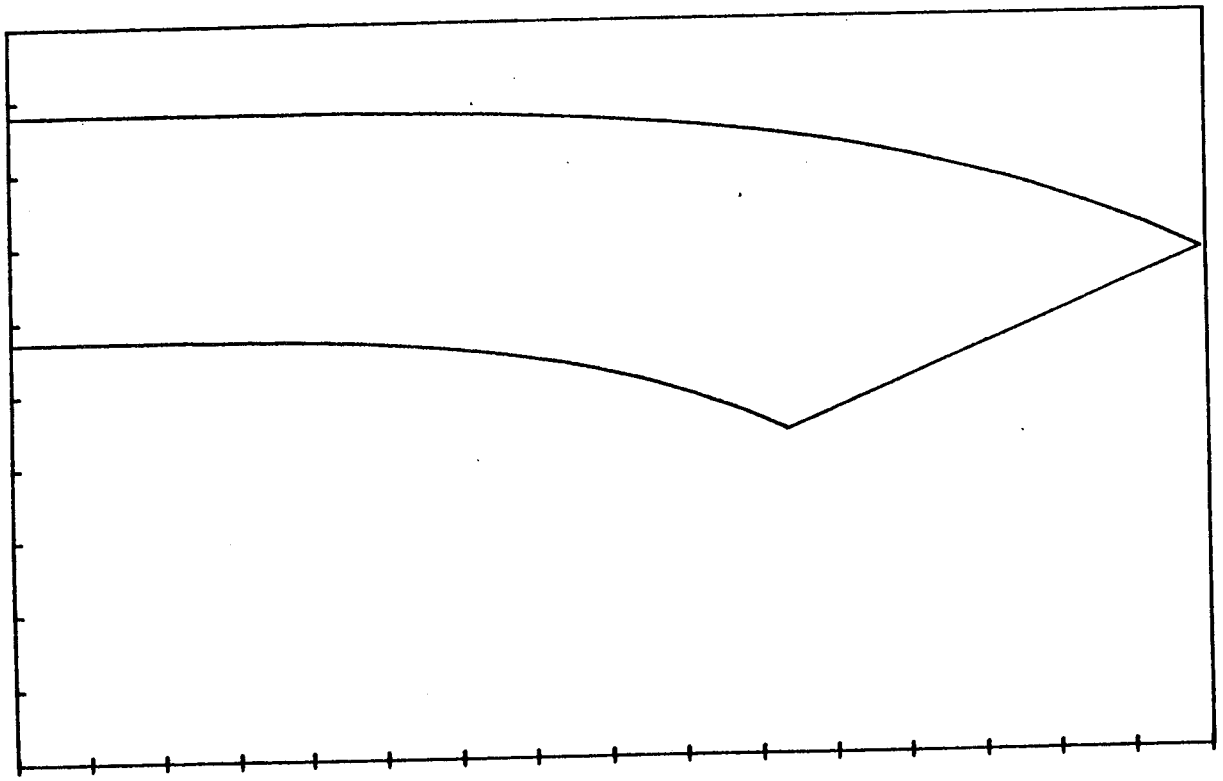
FIG. 7 shows the development of a vane of the first example according to the present invention on original scale.
Figure 8:
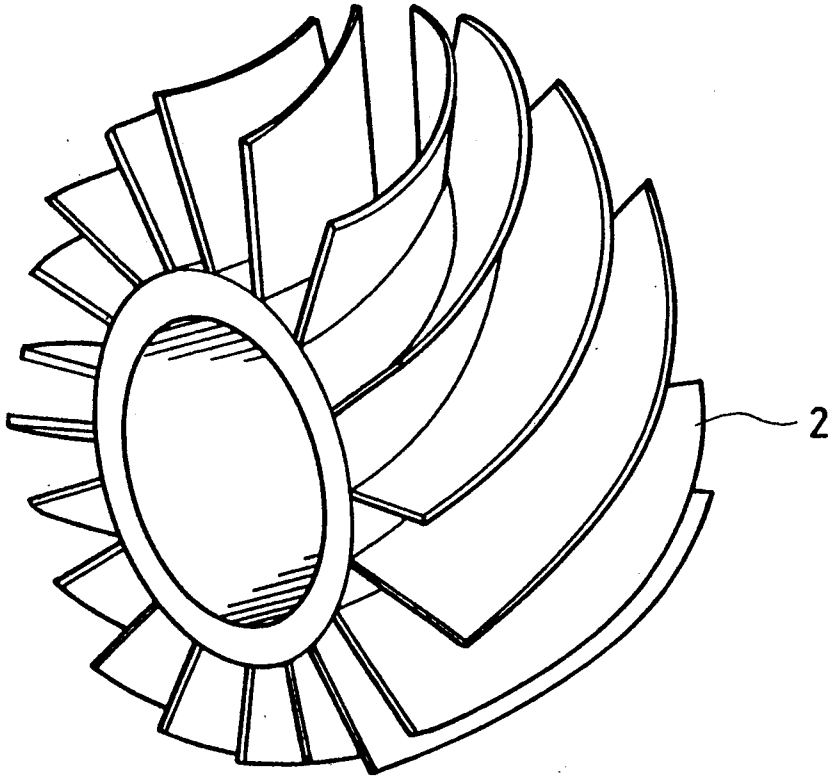
FIG. 8 is a perspective view of the first example of the present invention.

An Example is illustrated below for better comprehension:

1 Select $r_1 = 5.72$ cm, $r_2 = 8.80$ cm, $S = 0.7$, $\alpha = 27.2°$, $L = 9.7$ cm.
2. From eq. (16), $\Theta_o = 40°$.
3. From eq. (17), $R_1 = 15.1$ cm. From rational relationship, $R_2 = 23.2$ cm.
4. Substitute the above data into eq. (13). Plot the locus of the lower and upper boundaries of a vane on a plate. Connect the beginnings and the ends to obtain the development of a vane as shown in FIG. 7.
5. From eq. (15), the total number of vanes n = 19.
6. Produce 19 vanes according to FIG. 7.
7. Fix the 19 vanes equally spaced on a tube having a radius of 5.72 cm and a length of 9.7 cm. A swirl generator is thus obtained as shown in FIG. 8.

While the invention has been described by way of example and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. An axial vane for a swirl generator having an inner radius $r_1$ and an outer radius $r_2$, which has a lower boundary having a radius of curvature $R_1$ and an upper boundary having a radius of curvature $R_2$, wherein $r_1$, $r_2$, $R_1$ and $R_2$ have rational relationship that $R_1:R_2 = r_1:r_2$, with respect to a point $(u, \phi)$ of said lower boundary and a point $(u', \phi')$ of said upper boundary wherein deviation angles at said points are both $\Theta_k$, polar coordinates of said points on the development of the vane being represented by $$\left[\begin{array}{l} u = (r_1^2 + R_1^2\sin^2\Theta_k)^{\frac{1}{2}} \\ \phi = R_1 \int_0^{\Theta_k} \left[\dfrac{1 - R_1^2(r_1^2 + R_1^2\sin^2\Theta)^{-1}\sin^2\Theta\cos^2\Theta}{r_1^2 + R_1^2\sin^2\Theta}\right]^{\frac{1}{2}} d\Theta \end{array}\right.$$

and $$\left[\begin{array}{l} u' = (r_2^2 + R_2^2\sin^2\Theta_k)^{\frac{1}{2}} \\ \phi' = R_2 \int_0^{\Theta_k} \left[\dfrac{1 - R_2^2(r_2^2 + R_2^2\sin^2\Theta)^{-1}\sin^2\Theta\cos^2\Theta}{r_2^2 + R_2^2\sin^2\Theta}\right]^{\frac{1}{2}} d\Theta. \end{array}\right.$$

2. An axial vane for a swirl generator as claimed in claim 1, wherein the total number of the vanes n is the closest natural number of $$n = \frac{2\pi r_1}{R_1(\cos\alpha - \cos\Theta_o)}.$$

wherein $\alpha$ is an overlapping angle of the vane defined by equation $\alpha = K\Theta_o$, where $\Theta_o$ is the deviation angle at an end of the vane and K is a predetermined constant.

3. An axial vane for a swirl generator as claimed in claim 2, wherein the predetermined constant K is between 0.5 and 0.75.

4. An axial vane for a swirl generator as claim in claim 2, wherein the overlapping angle of the vane is 20° to 45°.

5. An axial vane for a swirl generator as claimed in claim 2, wherein the overlapping angle of the vane is 30°.

* * * * *